US005942679A

United States Patent [19]

Sandström

[11] Patent Number: 5,942,679

[45] **Date of Patent: *Aug. 24, 1999**

[54] COMPACTION INDEX

[75] Inventor: Åke Sandström, Sollentuna, Sweden

[73] Assignee: Geodynamik HT Aktiebolag, Stockholm, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/537,688

[22] PCT Filed: Apr. 29, 1994

[86] PCT No.: PCT/SE94/00388

§ 371 Date: Oct. 27, 1995

§ 102(e) Date: Oct. 27, 1995

[87] PCT Pub. No.: WO94/25680

PCT Pub. Date: Nov. 10, 1994

[30] Foreign Application Priority Data

Apr. 29, 1993 [SE] Sweden ..... 9301463

[51] Int. Cl.[6] ..... G01N 3/40

[52] U.S. Cl. ..... 73/78; 404/72; 404/133.05; 73/573; 73/579

[58] Field of Search ..... 73/78, 84, 573, 73/594, 579; 364/550; 404/133.05

[56] References Cited

U.S. PATENT DOCUMENTS

| | | | |
|---|---|---|---|
| 4,103,554 | 8/1978 | Thurner . | |
| 4,348,901 | 9/1982 | Vural et al. | 73/594 |
| 4,467,652 | 8/1984 | Thurner et al. . | |
| 4,504,176 | 3/1985 | Lindberg et al. | 404/133.05 |
| 4,590,802 | 5/1986 | Furmanski | 73/78 |
| 4,734,846 | 3/1988 | Konig | 73/78 |
| 4,870,601 | 9/1989 | Sandstrom | 364/550 |
| 4,943,930 | 7/1990 | Radjy | 73/573 |
| 4,959,994 | 10/1990 | Paakkinen | 73/38 |
| 5,164,641 | 11/1992 | Quibel et al. | 73/573 |
| 5,415,494 | 5/1995 | Steffen | 404/133.05 |

FOREIGN PATENT DOCUMENTS

| | | | |
|---|---|---|---|
| 0027512 | 4/1981 | European Pat. Off. . | |
| 3336364 | 4/1995 | Germany . | |
| 309859 | 11/1992 | Japan | 73/78 |
| 673912 | 7/1979 | U.S.S.R. | 73/573 |

*Primary Examiner*—Hezron Williams
*Assistant Examiner*—Nashmiya Fayyaz
*Attorney, Agent, or Firm*—Birch, Stewart, Kolasch & Birch LLP

[57] ABSTRACT

In compacting an asphalt layer which is continuously deposited by a paver machine, a compacting machine reciprocates behind the paver. With the aid of signals from sensors (3) for temperature, sensors (5) for movement velocity of the compacting machine, sensors (7) for change of path, and sensors (9) for static/vibratory compacting operation, a processor (1) determines the position of the compacting machine continuously in relation to the paver, and other variables for each area segment passed by the compacting machine. The position of the compacting machine is displayed symbolically on a monitor (19) and the variables measured and determined for each passed area segment are stored in a memory (17). For each passed area segment, a total index number can be determined for this area segment, which on the monitor (19) is displayed as a field having a color or light intensity which is proportional to this total index number. The index number indicates the total amount of compacting work which the compacting machine has made on this area segment. This position of a field representing such an area segment is displayed on the monitor (19) in a proportional scale.

18 Claims, 5 Drawing Sheets

| Project No./Identifying Data |
|---|
| Data particular for Project |
| Constantly adjusted Compacting Machine Data |

| Region (m) | Path No. | Pass No. | Temp. | Velo-city | Vibr./ no Vibr. | Fre quen-cy | Ampli-tude | Calc. partial index |
|---|---|---|---|---|---|---|---|---|
| 0 | 1 | 1 | . | . | . | . | . | . |
| " | " | 2 | . | . | . | . | . | . |
| " | " | 3 | . | . | . | . | . | . |
| " | " | 4 | . | . | . | . | . | . |
| " | " | Total | | | | | | . |
| 0 | 2 | 1 | . | . | . | . | . | . |
| " | " | 2 | . | . | . | . | . | . |
| " | " | 3 | . | . | . | . | . | . |
| " | " | 4 | . | . | . | . | . | . |
| " | " | Total | | | | | | . |
| | | | | | | | | |
| | | | | | | | | |

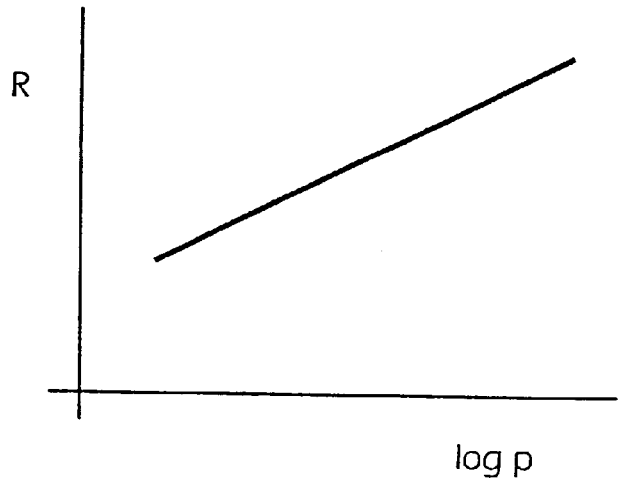
Fig. 8 Compaction result as a function of the number of passes

COMPACTION INDEX

FIELD OF THE INVENTION

The present invention is related to measurement and documentation of results of compacting work and to control of a rolling compacting machine in the compacting of a deposited ground surface, in particular asphalt. It is related to methods and devices arranged on the compacting machine for measurement, documentation and control of the compacting work for ensuring a uniform result of the compacting work.

BACKGROUND OF THE INVENTION

For the compacting of earth there exists a plurality of equipment based on various types of compaction gauges or measuring devices. Documentation is normally made by means of devices showing a summarized picture of the result. At the same time, the corresponding data is stored in some suitable medium. Further processing and entering of the obtained measured results in a suitable data base can then be performed in a personal computer arranged at another location. When compacting asphalt, the tested methods from the compacting of earth cannot be transferred without due consideration. This is true for primarily two reasons:

1. It does not yet exist any functioning compaction measuring device showing the result of the compacting of the asphalt layer as measured continuously directly from the compacting machine. The nuclear measurement devices which are known and are to be mounted on the compacting machine itself, have a limited use since they require long integration time to produce accurate information and since the use thereof is impeded by the restrictions prescribed by the authorities owing to the radiation.
2. In compacting asphalt it is not possible to control the movement of the compacting machine, so that a large rectangular surface could be compacted to a finished state before the compacting machine is used for compacting another large rectangular area. Instead, the compacting of asphalt is performed continuously accompanying the deposition of the asphalt by an asphalt paving machine which can move forward continuously with an approximately uniform velocity over a distance which often several hundreds of meters. The paving operation is normally stopped only at breaks and if the supply of new asphalt compound fails.

In compacting asphalt the compacting machine follows the paver machine according to a scheme having limited possibilities of variation. A postcompaction of some areas where a too low compaction degree has been detected can only be performed if more than one compacting machine is available.

It is also advantageous to have access to equipment which can document the compacting work performed which together therewith stores all relevant operational parameters.

Even if there would be limited possibilities of correcting mistakes by having the compacting machine afterwards compact badly worked asphalt portions it may be a great value if the system successively produces continuous information by which it is possible to adjust those operational parameters so that the result of the compacting work can successively approach an optimum result. Adjustable parameters can be the distance or stroke length over which the compacting machine travels before it reverses its running direction to move in the opposite direction; the interior operational parameters of the compacting machine; and the velocity of the asphalt paver.

SUMMARY OF THE INVENTION

It is a purpose of the invention to provide a measurement of the degree of compaction of a continuously deposited layer of a material.

It is a further purpose of the invention to provide documentation of the compacting work when compacting a continuously deposited layer of a material.

It is a further purpose of the invention to provide a system for continuous information to an operator when compacting a continuously deposited layer of a material.

It is a further purpose of the invention to provide means for displaying parameters associated with the compacting work and the achieved compaction effect when compacting a continuously deposited layer of a material, whereby an operator can adjust operational parameters in order to achieve a desired compaction effect on each area segment passed.

According to the invention methods and devices are provided by means of which the purposes mentioned above can be achieved.

In the measurement of the degree of compaction in a segment of a deposited layer of hot material, in particular asphalt compounds, which continuously cools after the deposition thereof and is compacted by being repeatedly passed or run over by a compacting machine, for each pass or run over the segment variables or parameters are determined. The variables as parameters are determined, by means of various measuring devices and sensors arranged on the compacting machine. As a measurement of the compaction degree of a deposited segment layer, a total index number is determined as a function of these variables for all the passes performed. This index number function also depends on different fixed, exterior parameters such as the type of vibration of the compacting machine, the type of material/asphalt compound, the thickness of the deposited layer, the ground temperature, the temperature of the ambient air, and the wind velocity.

Preferably for each pass a partial index number is determined as a function of the variables only for one pass. The total index number is then determined as a function only of the sum of the partial index numbers for each pass. It can be observed that a sum of variables is equivalent to a product of exponentiated variables.

Further, preferably the temperature of the segment is measured at each pass of the area segment such as by means of a thermometer arranged on the compacting machine. The partial index numbers are then determined as a function of the temperature of the segment for the corresponding pass. The movement speed of the compacting machine is measured for each pass and then the partial index number for an area segment can be determined as a function of this movement speed at the corresponding pass of the area segment.

For a vibrating compacting machine, and for each passed area segment the vibratory frequency and/or vibratory amplitude of the compacting machine is determined by means of suitable sensors on the compacting machine. The partial index number of an area segment can in this case be determined as a function of the vibratory frequency and/or the vibratory amplitude respectively for the distance traveled by the compacting machine over the area segment.

The predetermined function is in an advantageous embodiment of a product of functions, where each one depends on only one of the variable quantities. It should be pointed out that for logarithmical entities a product of the variables is equivalent to a sum.

The measurement can be used for controlling the compacting machine in compacting the layer which is in a hot state and is continuously deposited by a paving machine in front of the compacting machine. The compacting machine passes over the area behind the paver to compact the layer just deposited. For each unit area of the layer deposited by the paver which is passed by the compacting machine, the total index number is determined as a function of the variables as measured for this unit area and also of suitable operational parameters of the compacting machine and fixed values for the layer of material. The travel of the compacting machine over the individual areas and the operational parameters of the compacting machine can be controlled by means of the measured total index number, so that the total index number will achieve at least a predetermined value for each unit area.

In practical work the compacting machine passes over repeatedly the area behind the paver machine and then a partial index number is determined for each unit area for each pass of the compacting machine over this unit area as a function of the variable quantities measured for this unit area and of the operational parameters of the compacting machine and of possible other fixed parameters. The total index number for each unit area is calculated as the sum of the partial index numbers determined for each pass of the unit area.

The total index number is advantageously calculated continuously for each unit area and further, it is displayed for an operator of the compacting machine so that he will be able to control the compacting machine as efficiently as possible. The total index number for each unit area is then suitably shown on a monitor or display, located adjacent to a driver's place in the compacting machine, where the shape of the fields on the display correspond to and are proportional to the real position of the unit area. The fields can be shown in light or colour intensity proportional to the total index number calculated for this unit area or they can be shown in a colour scale. This color scale is arranged to correspond to the various possible total index numbers. The colour is chosen so that it corresponds to the calculated total index number of the unit area.

Further, in suitable memory means, data is recorded about compacting the layer, which is continuously deposited in front of and being compacted by a compacting machine which moves over the layer. Like above, sensors and/or measurement devices are arranged for the measurement of variables valid only for each area segment passed by the compacting machine. The position of the compacting machine at each instant is calculated or measured. Further, memory means are arranged for storing, together with the position of the compacting machine in coordinates for each area segment passed by the compacting machine, data values representing the measured variable quantities so that a data record comprising measured values is obtained for each pass of each area segment.

Sensors and/or measurement devices comprise a measuring device arranged on the compacting machine for measuring the surface temperature of the deposited layer in the area segment which is just passed by the compacting machine. The stored data values then comprise the temperature measured by this sensor for each pass and for each area segment.

A measurement device can also be arranged for recording the instantaneous movement velocity of the compacting machine where the position of the compacting machine is calculated at each instant from the recorded movement speed of the compacting machine.

An indicator can further be arranged for indicating whether the compacting machine vibrates and then the condition of vibration or no vibration can be calculated in the stored data values.

When the compacting machine is vibrated or is of the vibratory type, a sensor can be arranged for indicating the frequency and amplitude of the vibration and in this case the frequency and the amplitude of the vibration can be calculated in the data values stored for each area segment.

From the variables determined for a pass, a partial index number can be determined as a function of the variables only for the one pass and then this partial index number can be stored.

A total index number can be determined as a function of the sum of (corresponds to the product for values which have been exponentiated) the partial index numbers for each pass. This total index number then can be stored.

The temperature of the segment can be measured for each pass and then the partial index numbers can be determined as a function of the temperature of the segment at the corresponding pass.

The movement velocity of the compacting machine can also be measured for each pass and then the partial index numbers are determined as a function of the temperature of the segment for the corresponding pass.

The movement velocity of the compacting machine can also be measured for each pass and then the partial index numbers are determined as a function also of the movement velocity for the corresponding pass.

A driver's interface for the control of a compacting machine when compacting a layer which is continuously deposited by a paving machine moving in front of the compacting machine, generally comprises; means for measuring, calculating and showing on a display at each instant symbols representing the paver and the compacting machine itself; and the position of these symbols in relation to each other being proportional to the real positions of the compacting machine and the paver. Further input means are provided for the driver's interface entering a start value for the compacting machine in relation to the paver; a value for a correction; and a desired value for a later displacement of the displayed symbol of the compacting machine in relation to the paving machine. The symbol representing the paver is advantageously fixedly located at a side or border of the monitor.

Suitably, the symbol representing the compacting machine on the display has a distance from the symbol representing the paver which is proportional to the real distance of the compacting machine from the paver. The lateral position of the symbol representing the compacting machine can be displayed as a position within one of several parallel elongated fields or paths, which extend in parallel to the deposition direction of the layer up to the paver, perpendicularly thereto.

In a method for controlling and/or monitoring a compacting machine, in particular the position thereof, in compacting a layer which is continuously deposited by a paving machine moving in front of the compacting machine, the driver's interface can be used. The position of the compacting machine in relation to the paver is then shown symbolically on a monitor at all times by a symbol representing the compacting machine and a symbol representing the paver and the relative position of these symbols will proportionally represent the positions of the compacting machine and the paver in relation to each other. An operator will, by looking at the display, obtain information of the relative distance and the relative position of the compacting machine in relation to the paver and can control the movement and/or operational parameters of the compacting machine. For instance, the stroke length of the compacting machine within each path or lane can be ascertained when a change of path is to be performed so that the compacting machine performs efficiently as possible to compact the deposited layer.

The instantaneous movement speed of the compacting machine can be measured and accordingly the position of the compacting machine at each instant can be determined by the movement speed as measured for the compacting machine. This determined value is then used for a further determination of the position of the symbol representing the compacting machine to be shown on the display.

In the case where the compacting machine moves reciprocally, in parallel to the deposition direction, up to the paver as in a direction backwards from the paver, the position of the compacting machine in relation to the paver can be continuously determined and shown on a display or monitor. A symbol representing the compacting machine on the monitor will have a distance from a symbol representing the paver which is proportional to the present distance of the compacting machine from the paver. The lateral position of the compacting machine's symbol can be shown as a position within one of several parallel elongated fields or paths extending in parallel to the depositing direction of the layer up to the paver.

In certain cases it can be assumed that the compacting machine changes its direction at substantially the same distance each time when it approaches the paver machine and then the movement velocity of the paver can be determined from those positions where the compacting machine changes its direction close to the paver.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 8 shows a diagram of a curve illustrating the compaction effects at successive passes.

DESCRIPTION OF PREFERRED EMBODIMENT

Figure 1A:
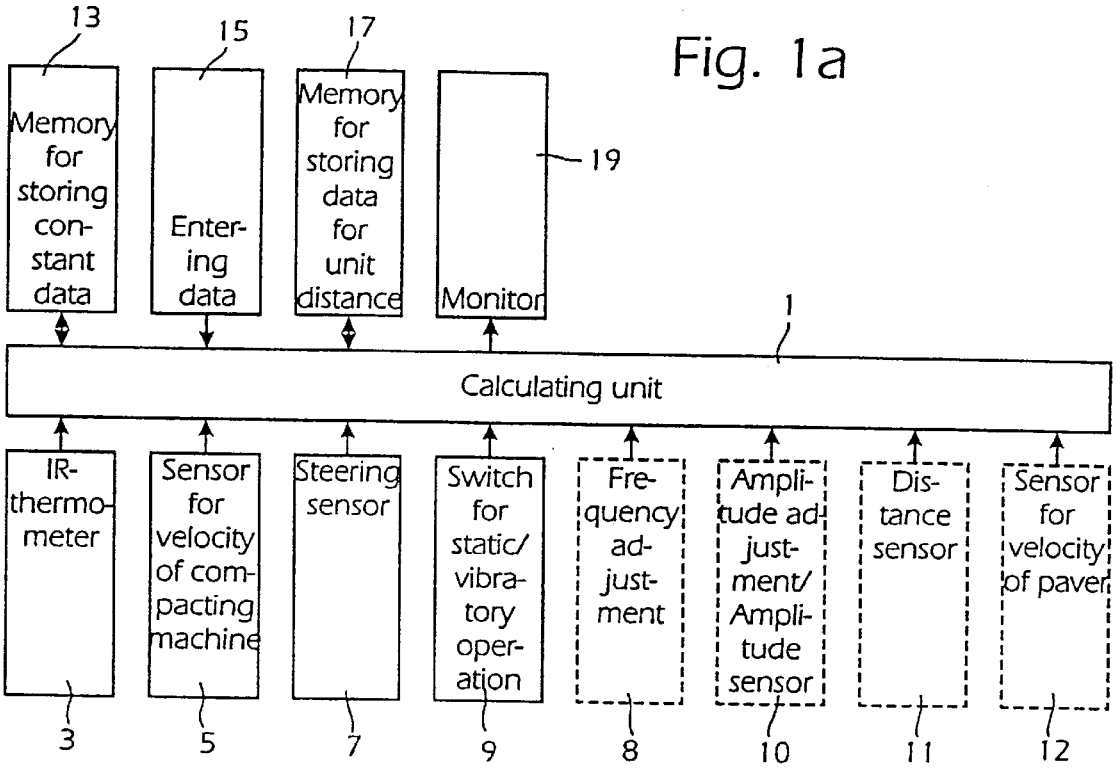
FIG. 1A shows a block diagram of a device in a compacting machine for control and documentation of the compaction of a deposited asphalt layer, FIG. 1B schematically shows the front portion of a compacting machine.
Figure 1B:
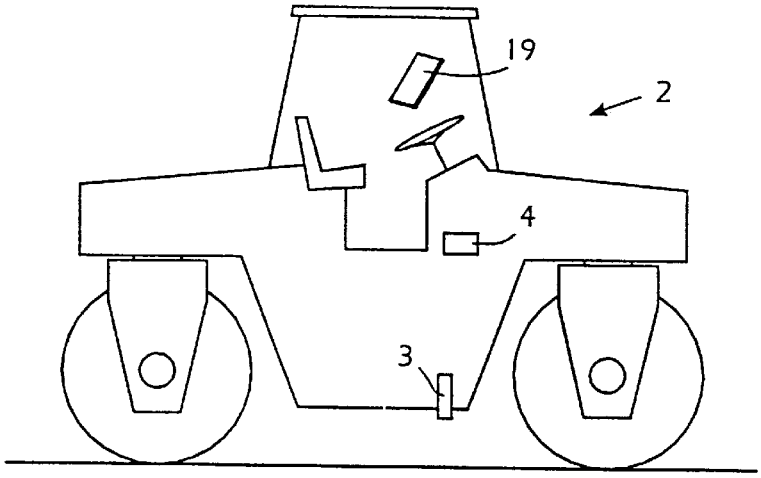

A block diagram of a device for control and documentation of compacting work in compacting a deposited layer such as asphalt is shown in FIG. 1A. The device comprises various units arranged on and in a roller compacting machine, see the item at 2 in the schematic picture of FIG. 1B, the machine being the static, vibratory or oscillating type. The central part of the device is a calculating unit or processor 1 located in some casing 4 in the compacting machine. The calculating unit 1 receives, when the compacting machine 2 is running, continuously information from suitable sensors in respect of various parameters influencing the compacting of a deposited asphalt layer. They comprise a thermometer 3 of IR-type, arranged on the compacting machine and measuring the surface temperature of the deposited mass close to the compacting machine. A sensor 5 measures the movement velocity of the compacting machine, which can be coupled to the drive motor of the compacting machine, the driving wheels of the compacting machine, or to the compacting roller itself. There is a steering sensor 7, generally called sensor for change of path or of lane, which can be arranged to sense the movements of the steering wheel or the angle of a steering rod hinge to detect such movements signifying a change of path or lane. Further there is a device or switch 9 indicating whether the compacting roller only performs a static compacting work or if it is vibrated. In the case where it is vibrated a signal is provided representing the frequency and amplitude of the vibration, from sensors indicated at 8 and 10 respectively. A sensor 11 can also be arranged for providing a signal representing a distance, i.e. the distance from the compacting machine to a paving machine. The paving machine is supposed to work continuously in front of the compacting machine and deposit an asphalt layer with an essentially uniform velocity. Finally there may also be an input terminal or a receiver 12 to provide the processor 1 with wireless conveyed information related to the movement velocity of the paver.

The calculating unit 1 has in addition access to stored and previously entered data in a memory unit 13. The data is entered from some unit 15, e.g. the shape of a keyboard and/or some magnetically readable medium such as a memory card. In the latter case, the input unit 13 and the memory unit 15 can then be one device.

Figures 6, 7:
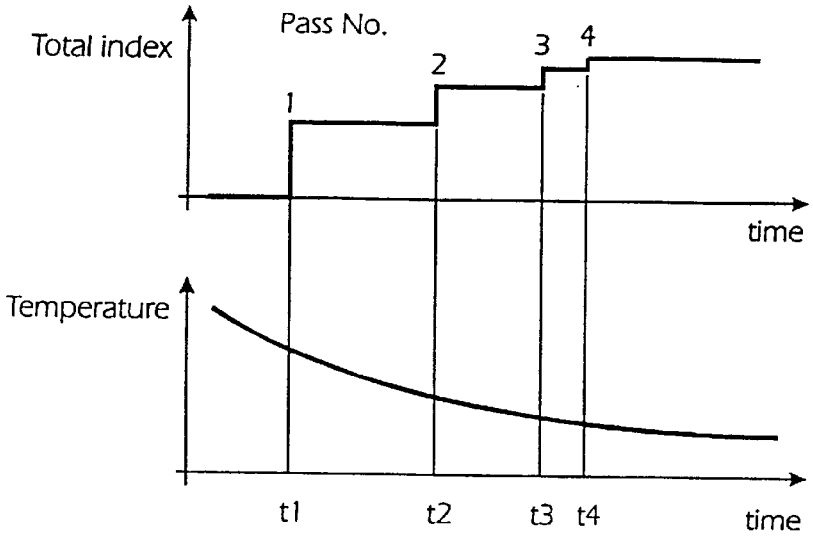
FIG. 6 shows two diagrams, at the top the total index for considered area segment as a function in time and at the bottom the temperature of the asphalt compound within this area segment as a function of time.
FIG. 7 shows schematically the organization of a stored list of compaction data.

The calculating unit 1 performs for each unit segment or unit distance, over which it passes, for instance for a distance of one meter or two meters, calculations of (among other things) the position of the compacting machine, in particular the position of the compacting machine in relation to the asphalt paver, by means of data obtained from the sensors 5 and 7. It may be considered that for this calculation also other kinds of sensors and systems can be used, which are not shown here, for instance gyro sensors, receivers of GPS signals, position signals from fixedly placed total stations (target following geodetic stations for measurement of distance and angular position), etc. Various data for each passed segment of each path or lane are stored in a memory unit 17 in the shape of a list which is schematically illustrated in FIG. 7. Certain actual data, also for earlier passed areas, are shown on a monitor 19 connected to the calculating unit 1.

Figure 2C:
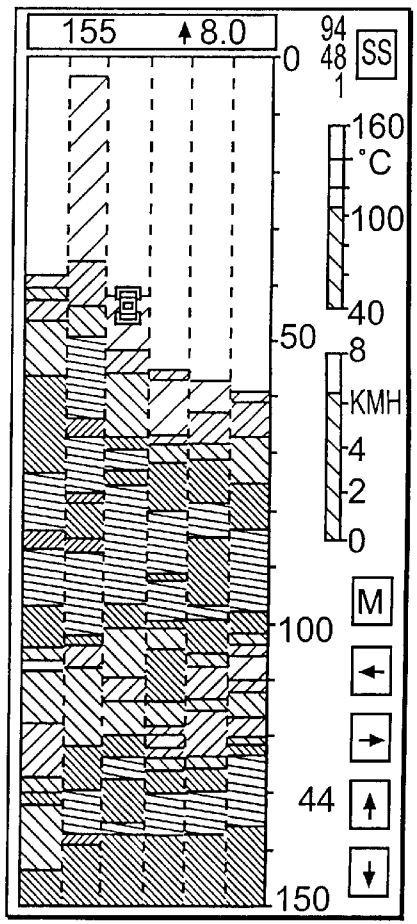
FIGS. 2A–2C show successive monitor pictures used for presentation of results and for control of the compacting machine.
Figure 2B:
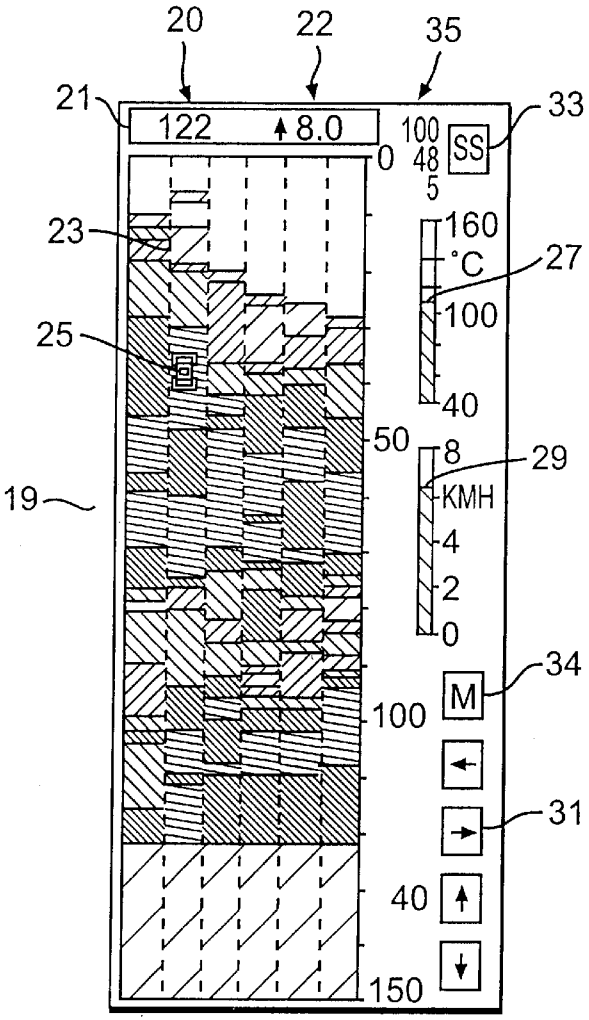
Figure 2A:
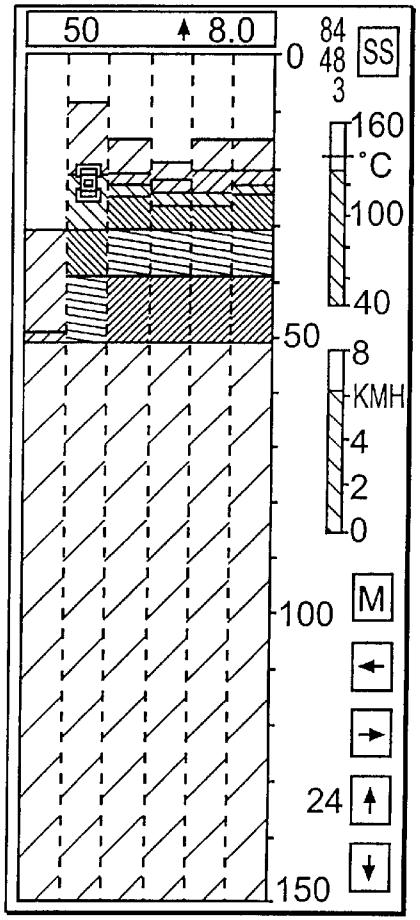

In FIGS. 2A–2C successive monitor pictures are illustrated intended to be shown on the monitor or the display 19 located in the driver's cabin in the compacting machine, not shown. The calculating unit 1 thus calculates at all times (based on the velocity of the compacting machine as given by the signals from the velocity sensor 5 and information on start and stop times and times for change of direction as obtained from the steering sensor 7) the position of the compacting machine in relation to the paver. The paver machine is shown as an elongated field 21 at the top of the elongated monitor picture, where field 21 has its longitudinal direction located perpendicular to the longitudinal direction of the entire monitor 19. Perpendicularly to the symbol 21 representing the paver, parallel lines extend having an equal spacing and they thus extend in the longitudinal direction of the monitor picture. This equal spacing represents substantially the compacting width which is obtained in the movement of the compacting machine over the asphalt. The region between every two of these parallel lines located adjacent to each other represents the lanes or areas for the compacting machine when performing the compacting work and the position of the compacting machine is shown as a symbol 25 in such a path or lane. If a distance measurement device 11 is mounted on the compacting machine, the output signal therefrom can be used for determining the position of the compacting machine in relation to the paver, so that a correct representation can be made on the display 19. It should be emphasized that the monitor picture at all times shows the relative position of the compacting machine in relation to the paver. A length scale, e.g. in meters, can be provided at the side of the displayed picture, which shows the paths or lanes.

The total passed running distance of the compacting machine from the start thereof is shown as an indication of a number of meters at 20 within the field 21 symbolizing the paver. Checkpoints such as pegs or stakes or similar devices located at definite places adjacent to the deposited material layer can be used for correcting this indication of the position of the paver.

Also other parameters can be shown on the display 19 such as the calculated velocity of the compacting machine, or the velocity thereof as received by the unit 12, which can be shown with a suitable digit or figure at 22 within the symbol 21 representing the paver. The temperature of the asphalt layer measured close to the compacting machine in the shape of a suitable thermometer scale is shown at 27 and the present velocity of the compacting machine, also shown in the shape of a bar scale or thermometer scale at 29. On or adjacent to the display manual operating means are provided such as keys shown at 31, 34 for a manual displacement of the compacting machine symbol 25, so that the position thereof can be corrected or for indication of a start position at the beginning of the deposition of the asphalt layer or a start of the compacting operation as performed by the compacting machine. Further a start and stop key 33 is arranged which is to be depressed by the driver of the compacting machine at the start and stop of the paver.

The calculating unit 1 performs a calculation of the total effect of the compaction on each unit area of the deposited asphalt layer. A unit area is here equivalent to each path or lane, over which the compacting machine passes. The unit area will be recorded and a calculation is made for fixed passed unit distances such as one or two meters. Generally the total compaction effect on a considered unit area results from the fact that a number of compacting machine passes have been made in different conditions. Thus the temperature of the asphalt compound varies behind the paver and the temperature falls gradually owing to the cooling effect. The compaction effect for a single considered pass can be assumed to be a function of the temperature, of the rolling velocity of the compacting machine, and of constant parameters of the compacting machine such as line load or roller charge, roller diameter, and vibratory data. The compaction effect in the different passes of the compacting machine over this considered unit area can be assumed to be additive and thus a sum for all the performed passes and independent of the time difference between the passes. It thus means that for each pass a calculation can be performed of the compaction effect exactly for this pass of the compacting operation on each unit area, after which the total effect is obtained as a sum of the calculated partial compaction effects and the total compaction effect will then be indicated as a measure of a compaction degree within the considered unit area of the deposited layer.

Figure 3:
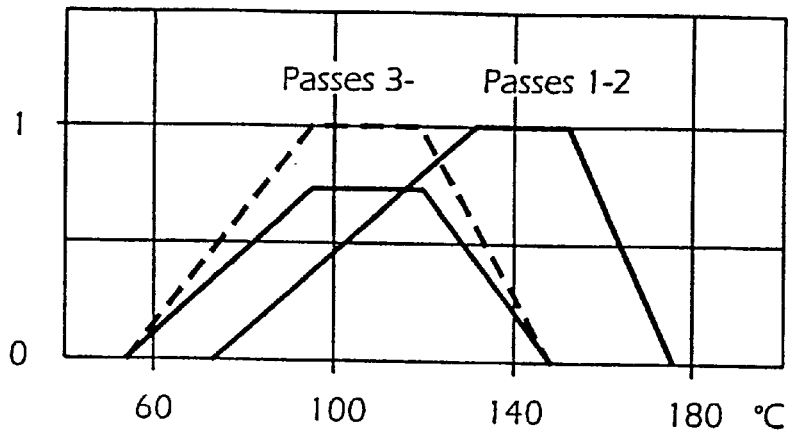
FIGS. 3–5 show examples of weight curves for the compaction result depending on the temperature of the asphalt compound, on the movement velocity and the vibratory frequency of the compacting machine.

The constant parameters of the compacting machine produces, at some temperature of a deposited layer of asphalt, a compaction effect which is supposed to be possible to calculate by means of the given and determined values. In FIG. 3 a diagram is showing how a simple weight function for the influence of the mass temperature could principally be constructed. The curve has as an abscissa the temperature of the asphalt layer and as an ordinate an estimated value of the compaction effect at the respective temperature. The ordinate of the curve has its maximum value equal to 1 in a temperature interval which is ideal for the first runs or passes. When the compaction effect deviates from the ideal value equal to 1, the compaction effect of the pass is reduced and the ordinate of the curve has a lower value. For a sufficient deviation even a negative value can be obtained even if it is not visible in the curves of FIG. 3. In FIG. 3 a weight function is illustrated valid for the two first passes and another weight function for all following passes. In a preferred case, not illustrated here, even different weight functions can be used for each one of the three first passes and a separate weight function for all the following passes. Weight functions of this kind can be determined by experience and aided by experiments.

Figure 4:
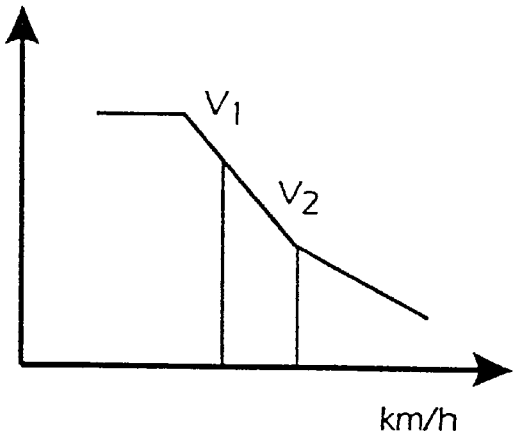
Figure 5:
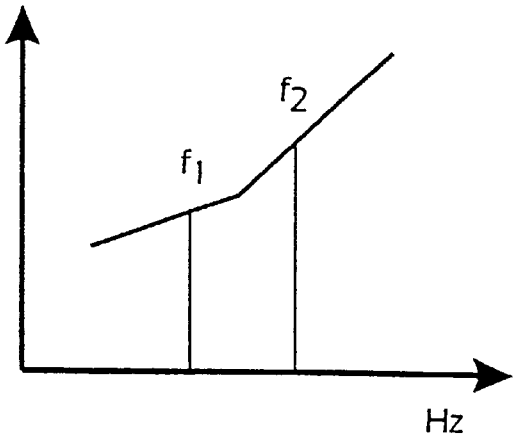

Similar curves can in a corresponding way be constructed for the influence of different compacting machine parameters such as rolling velocity, amplitude and frequency, on the compaction result. Examples are illustrated in FIGS. 4 and 5 where a weight curve is shown dependent on the movement speed of the compacting machine and dependent of the frequency of the vibratory movement of a vibratory compacting machine respectively. In a preferred embodiment also the weight curve according to FIG. 4 for the dependence on the movement speed can be replaced by four different weight functions for both the three first passes and one for the following ones.

The different values obtained from the ordinate value in curves of the kinds illustrated in the FIGS. 3–5 are multiplied by each other for obtaining a partial index number for a particular pass and a considered unit area. Such a partial index number or number of points, which is determined for each individual pass, are then added successively for the production a total index number or a total number of points for each unit area.

From FIG. 3 and the discussion accompanying it, it is obvious that the compaction effect for a considered area segment and for a certain pass does not uniquely depend on the temperature but also on the earlier history in compacting the segment, i.e. in this case on the order number of this pass.

The partial contribution to the total index number which is obtained for a considered area segment and for a certain pass, generally depends on 1. Variable or measurable variables such as
   the temperature of the deposited material,
   changeable parameters of the compacting machine such as the movement speed, the vibratory frequency, the vibratory amplitude.
2. Parameters which are constant for a compacting work in the deposition of the material at a definite occasion, such as
   constants for the mass such as type of material, thickness of the deposited layer,
   constants for the compacting machine such as type of compacting machine, line load, radius of the rolling drum, and
   weather and wind.
3. The early history of the considered area segment in the shape of
   the degree in which the paving machine compacts the material when depositing the material,
   the number of passes run before the considered pass,
   time intervals between the passes,
   values of variables for the passes earlier run.

From earlier experience in compacting earth at constant other conditions it is known that the total index number R of the compaction increases approximately proportionally to the logarithm of the number (p) of passes or runs, see FIG. 8. The partial index E for a certain pass having order number p can then be $$E = \frac{dR}{dp} = \frac{1}{p} \tag{1}$$

It can be assumed that the ground or surface layer is completely uncompacted before the first pass. Normally a certain precompaction occurs or is present which is produced by the paver of the material. It varies depending on the type of paver machine, such as if it is of type rammer, vibrating skid, etc. In order to describe the effect of a certain compacting machine pass, the partial index for a pass having the order number p can then instead be written $$E = \frac{1 + p_0}{p + p_0} \tag{2}$$

where $p_0$ is a measurement of the precompaction degree expressed in the number of equivalent compacting machine passes.

A consideration of the generally reduced compacting effect for later passes has already been made for the curves in the diagram according to FIG. 3, where the maximum value of the weight curve for passes having order number from and including the third pass is smaller than the maximum value for the weight curve valid for the two first passes. It can however be advantageous to separate these two effects, so that the curves of FIG. 3 all will have the same maximum value, e.g. equal to 1, which is illustrated by the curve drawn in dotted lines for passes from and including the third one. Like above then, for obtaining the partial index number for a certain considered unit area, the various factors are multiplied which are obtained from curves of the type as illustrated in FIGS. 3, 4, and 5, and also a general reduction factor obtained from equation (2) with a suitable choice of the constant $p_0$.

In FIG. 6 in the top diagram, the total index number is shown for a considered area segment as a function of time. In the bottom diagram the temperature of the asphalt within this area segment is shown as a function of time. The temperature curve is a continuously decreasing function and the total index number increases stepwise for each pass which is performed at the times $t_1$–$t_4$, where larger steps are used for the first passes, when the asphalt has a low degree of compaction and still is hot, and smaller steps for the later passes.

On the monitor 19 and within the area segments of the different paths or lanes, which are passed by the compacting machine, the calculated total number of points for each unit area or unit distance is illustrated with a varying light intensity such as with a grey scale. The greyness of each area segment can be shown as representing the ratio of the achieved total number of points to a minimum number of points which is to be achieved for the asphalt layer in order that the compaction thereof should be considered as acceptable. The surface portions passed by the compacting machine are shown in the monitor pictures of FIGS. 2A and 2B at the top in varying grey shades and at the bottom in these pictures the homogenous grey area portion represents a ground surface which is not compacted but is located "in front" as seen in the depositing direction for the layer. Such an equally grey surface portion is not represented in FIG. 2C since this monitor picture is valid for a time where the compacting machine during this operation has had time to compact a longer longitudinal region. FIGS. 2A–2C thus show the compaction result at three successive times. Instead of using intensities in a grey scale also colours of a suitable colour scale can be used if a colour monitor is used. Another alternative can be to use digital number values of the total index number for each area segment.

The driver of the compacting machine can use this information comprised in the varying greyness of the display picture to adjust the velocity of the compacting machine, the length of stroke for displacement within each path or lane and possibly other compacting machine parameters to optimize the result of the compacting work, in particular to achieve the desired minimum total number of points for each area segment. The driver can also demand or request a lower velocity of the paver in the case it appears that he cannot achieve a sufficient compaction number of points, or contrarily, request the paver to increase its velocity, in the case where the minimum number of points for the compaction degree is easily obtained and thus an excess of the compaction capacity of the compacting machine exists.

At the top of the screen at 35 the number value are shown representing the total index number achieved up to now and the partial index number for exactly that area segment over which the compacting machine now passes, and at the bottom, the number of the pass, as calculated from and including the first one, which is currently being performed by the compacting machine.

Before the start of the deposition of an asphalt layer and compaction thereof by means of the compacting machine, (for documentation of the object and to form a base for the calculation of weight curves) project identification and project data are entered, as well as data for the compacting machine, data for the asphalt layer such as type, the thickness, etc. thereof, and the planned velocity of the paver, which information in all its essential parts is stored in the memory 17. See in particular the top fields in the list of FIG. 7. Most of these values need not be changed as long as the compacting machine performs the same type of compaction work. Before each work pass the driver of the compacting machine must, however, enter the starting section and further use the arrow keys 31 on the monitor 19 to adjust the present position of the compacting machine in relation to the asphalt paver, i.e. which path or lane on which the compacting machine stands, and the distance of the compacting machine to the paver in meters. Then the driver depresses key 33 for start/stop when the paver starts to deposit asphalt. During the pass then, in the fields illustrated at the bottom in FIG. 7, the various measured and determined parameters are stored as a function of the position of the compacting machine, i.e. parameters for each position of the compacting machine, which is for instance given by the segment as indicated in meters within a path or lane and path number with a numbering of the paths e.g. from the left in the monitor pictures of FIGS. 2A–2C. The parameters can comprise the measured temperature, the movement velocity of the compacting machine over the area segment, vibration or no vibration or for vibration the vibratory frequency and amplitude, the calculated partial index number for this pass. Further, also the total calculated index number is stored for each area segment, in the Figure in the record represented by the row having the name "Total", entered in the field for the number of the pass. Data entered in the Figure are indicated by dots (.).

The compacting machine thus passes the first present path or lane, performs a change of direction and when the compacting machine the first time changes its direction at a place close to the paver machine, the driver of the compacting machine should (if needed) adjust the position of the compacting machine symbol 25 in relation to the symbol representing the paver 21. For each succeeding change of direction at a place close to the paver the calculating unit 1 calculates the average velocity of the paver as taken from the previous change of direction close to the paver and then updates the corresponding number value showed within the paver machine symbol 21 on the monitor 19. Alternatively, the signal from a distance measuring device 11 and/or information in regard of the velocity of the paver as obtained form the unit 12 (FIG. 1A) can be used for a determination of correct positions and distances.

It can be mentioned that if all of the weight functions as mentioned above are given the constant value 1 over the definition regions thereof, also the function E (compare equation (2)), which only depends on the order number of the passes, on the monitor 19 in the different paths or lanes, fields will be indicated having grey shades of varying intensities indicating only the number of passes which have been made over each unit area. It can be of value for a rapid evaluation of the compacting work.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

I claim:

1. A method for measurement of the compaction degree of a segment of a deposited layer of hot asphalt, which continually cools after the deposition thereof and is compacted by being passed repeatedly by a compacting machine, the method comprising the steps of:

calculating asphalt segment values which are valid only for each pass made by said compacting machine;

calculating a total index number as a function of the asphalt segment values for all the passes made as a measure of the compaction degree of each segment; and controlling said compacting machine according to said asphalt segment values and said total index number to provide uniform compacting of said asphalt.

2. The method according to claim 1, wherein the calculating the total index number step further comprises the steps of:

calculating a partial index number as a function of the asphalt segment values valid only for each said pass; and calculating the total index number by the sum of the partial index numbers of successive passes.

3. The method according to claim 2, further comprising the steps of:

measuring temperature of each said asphalt segment at each said pass; and calculating the partial index number as a function of the temperature of each said asphalt segment at each said pass.

4. The method according to claim 2, further comprising the steps of:

measuring a velocity of the compacting machine at each said pass; and calculating the partial index number for each said asphalt segment as a function of the movement velocity at each said pass of each said asphalt segment.

5. The method according to claim 2, further comprising the steps of:

calculating at least one of a vibratory frequency and a vibratory amplitude of the compacting machine; and calculating the partial index number for each said asphalt segment as a function of at least one of the vibratory frequency and the vibratory amplitude respectively at each said pass of the compacting machine over each said asphalt segment.

6. The method according to claim 1, wherein the calculating the total index number step further comprises the steps of:

calculating a partial index number as a function of the asphalt segment values valid only for each said pass;

measuring temperature of each said asphalt segment at each said pass; and calculating the partial index number as a function of the temperature of each said asphalt segment at each said pass;

wherein the total index number is a product of functions; each function depending only on one of said asphalt segment values.

7. The method according to claim 1, further comprising the steps of:

continuously depositing asphalt layers which are in a hot state by a paving machine in front of the compacting machine;

passing over each said asphalt segment behind the paving machine to compact each said asphalt segment by said compacting machine;

calculating for each said asphalt segment deposited by the paving machine and passed by the compacting machine, the total index number as a function of the asphalt segment values measured for each said asphalt segment and of operational parameters of the compacting machine; and controlling travel of the compacting machine over each said asphalt segment and the operational parameters of the compacting machine so that the total index number for each said asphalt segment achieves at least a predetermined value.

8. The method according to claim 7, further comprising the steps of:

repeatedly passing areas behind the paving machine by said compacting machine, calculating a partial index number for each said asphalt segment for each said pass of the compacting machine over each said asphalt segment as a function of the asphalt segment values measured for each said asphalt segment and of the operational parameters of the compacting machine; and calculating the total index number for each said asphalt segment as a sum of the partial index numbers determined for each said pass of each said asphalt segment.

9. The method according to claim 7, further comprising the steps of:

continuously calculating the total index number for each said asphalt segment; and displaying said total index number to an operator of the compacting machine.

10. The method according to claim 9, further comprising the steps of:

displaying the total index number for each said asphalt segment on a display;

displaying at least one of said partial and said total index numbers of each said asphalt segment as fields having a location on the display which corresponds to and is proportional to actual locations of each said asphalt segment; and displaying the fields with at least one of light and colour intensity which is proportional to the total index number calculated for each said asphalt segment, the colour intensity including colours chosen in a colour scale, the scale being arranged to correspond to a plurality of total index numbers, the colour being chosen so that the fields correspond to the calculated total index number of each said asphalt segment.

11. A device for measurement of the compaction degree of a segment of a deposited layer of hot asphalt, which continually cools after the deposition thereof and is compacted by being repeatedly passed by a compacting machine, the device comprising:

first means for determination of asphalt segment values for each pass over each said asphalt segment, said values are valid only for each said pass; and calculating means for determination of a total index number as a measure of the compaction degree of each said asphalt segment, said total index number being a function of the asphalt segment values for all passes made over each said segment, whereby said compacting machine is controlled according to said asphalt segment values and said total index number to provide uniform compacting of said asphalt.

12. The device according to claim 11, wherein the calculating means determines for said each pass a partial index number as a function of the asphalt segment values determined by the first means, and said calculating means determines the total index number as a function only of the sum of the partial index numbers of successive passes.

13. The device according to claim 12, wherein the first means for determination comprises means on the compacting machine for measurement of a temperature of each said segment when each said segment is passed over by the compacting machine; and the calculating means determines the partial index number of each said segment as a function of temperature of each said segment at a corresponding pass.

14. The device according to claim 12, wherein said first determination means includes a device which measures movement velocity of the compacting machine and the calculating means determines the partial index numbers as a function of the movement velocity as measured for the compacting machine at a corresponding pass.

15. The device according to claim 11, further comprising:

a paving machine in front of the compacting machine continuously depositing layers of asphalt, the compacting machine repeatedly passing and compacting each said asphalt segment behind the paving machine;

the calculating means determines for each said asphalt segment deposited by the paving machine and passed by the compacting machine said total index number as a function of the asphalt segment values determined for each said asphalt segment by the first means for determination and of operational parameters of the compacting machine; and display means in a driver's cabin in the compacting machine for displaying said total index number of each said asphalt segment passed by the compacting machine in order to control travel of the compacting machine over individual asphalt segments and to control the operational parameters of the compacting machine so that said total index number for each said asphalt segment achieves at least a predetermined value.

16. The device according to claim 15, wherein the display means shows said total index number for each said asphalt segment in the shape of a field in an area on said display means which corresponds to and is proportional to an actual position of each said asphalt segment, the fields being shown with at least one of light and colour intensity which is proportional to said total index number calculated for each said asphalt segment, asphalt segments shown on said display means with a colour are selected in accordance with a colour scale, the scale being arranged to correspond to the various possible values of said total index number, and the colour being chosen so that the fields correspond to said total index number of each said asphalt segment.

17. The method according to claim 2, further comprising the step of:

calculating said partial index number according to the equation:

$$E = \frac{1 + p_o}{p + p_o}$$

where E is the partial index number; p is an order number for one pass; and $p_O$ is a measurement of a precompaction degree expressed in a number of equivalent compacting machine passes.

18. The device according to claim 12, wherein said calculating means determines said partial index number according to the equation:

$$E = \frac{1 + p_o}{p + p_o}$$

where E is the partial index number; p is an order number for one pass; and $p_O$ is a measurement of a precompaction degree expressed in a number of equivalent compacting machine passes.

* * * * *